US006490940B1

(12) United States Patent
Izquierdo et al.

(10) Patent No.: US 6,490,940 B1
(45) Date of Patent: Dec. 10, 2002

(54) MOTOR VEHICLE STARTER WITH REDUCTION GEAR COMPRISING MEANS FORMING TORSIONAL DAMPER

(75) Inventors: José Izquierdo, Villefontaine (FR); Pascal Jacquin, St Marcel Bel Accueil (FR); Pierre Valot, Oullins (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 09/622,709

(22) PCT Filed: Dec. 20, 1999

(86) PCT No.: PCT/FR99/03209

§ 371 (c)(1),
(2), (4) Date: Aug. 22, 2000

(87) PCT Pub. No.: WO00/39454

PCT Pub. Date: Jul. 6, 2000

(30) Foreign Application Priority Data

Dec. 23, 1998 (FR) ..... 98 16310

(51) Int. Cl.[7] ..... F02N 11/00; F16F 15/10
(52) U.S. Cl. ..... 74/7 E; 74/574; 475/347
(58) Field of Search ..... 74/7 E, 411, 574; 475/347, 346

(56) References Cited

U.S. PATENT DOCUMENTS 4,262,553 A * 4/1981 Bremer, Jr. ..... 74/574
4,848,172 A * 7/1989 Morishita ..... 74/7 E
4,862,027 A * 8/1989 Isozumi et al. ..... 310/99
5,323,663 A * 6/1994 Ohgi et al. ..... 74/7 E

FOREIGN PATENT DOCUMENTS

FR 2751803 1/1998

* cited by examiner

*Primary Examiner*—David A. Bucci
*Assistant Examiner*—Timothy McAnulty
(74) *Attorney, Agent, or Firm*—Liniak, Berenato & White

(57) ABSTRACT

The motor vehicle starter (10) has a casing (18) in which there is arranged an electric motor (12) which rotates a coaxial starter head (22) with the interposing of an epicyclic gearbox (34) including a ring gear (44) made of rigid material (M1) which is housed at least partially in a cavity (58) in the casing and which has an internally toothed cylindrical annular skirt (46) closed at its front axial end by a radially oriented transverse wall (50) with a hole at its centre (52) for the output shaft (42) of the gearbox to pass; the ring gear (44) has pins (P) moulded from a flexible material (M2), notably elastomer material, which are interposed between the ring gear (44) and complementary portions (68) of the cavity (58) of the casing (16, 18) in order to immobilise the ring gear (44) rotationally with respect to the casing (18) and provide a function of torsion damping between these two components (44, 18).

11 Claims, 3 Drawing Sheets

MOTOR VEHICLE STARTER WITH REDUCTION GEAR COMPRISING MEANS FORMING TORSIONAL DAMPER

BACKGROUND OF THE INVENTION

1. Field of the Invention

The present invention concerns a motor vehicle starter.

The invention concerns more particularly a motor vehicle starter of the type having a casing in which there is arranged an electric motor whose output shaft rotates a coaxial starter head with the interposing of an epicyclic gearbox comprising a gear wheel made of rigid material, with internal teeth, which is housed at least partially in a cavity in the casing in which it is immobilised with respect to rotation by means by cooperation of shapes and which has an internally toothed cylindrical annular skirt closed at its front axial end by a radially oriented transverse wall with a hole at its centre for an output shaft of the gearbox to pass.

2. Description of Related Art

The compression times of the thermal engine, during the driving phase, cause variations in load and the taking up of angular play in the different gears. The result is vibrations and shocks harmful to the service life of the starter. This phenomenon is accompanied by an emission of sound sufficiently intense to be perceived unpleasantly by the user.

According to a known design, in order to reduce the high mechanical overloads transmitted to the rotating components of the starter, which result from the abrupt variations in speed arising during the starting period because of the abrupt slowing of the thermal engine which can occur following the first explosions which are too far advanced with respect to the passage through top dead centre of the pistons, it has been proposed to associate, with an epicyclic gearbox, one or more dampers consisting of blocks of rubber which stop the ring gear of the gear train rotation-wise.

This solution is however bulky, uses additional components and causes a high additional cost whilst complicating the operations of assembling the components of the gearbox and/or starter.

SUMMARY OF THE INVENTION

The object of the invention is to propose a novel design of starter of the type mentioned above which remedies the drawbacks which have just been mentioned.

For this purpose, the invention proposes a starter, characterised in that the ring gear has pins moulded from a flexible material, notably elastomer, which are interposed between the ring gear and complementary portions of the cavity of the casing in order to immobilise the ring gear rotation-wise with respect to the casing and provide a torsion damping function between these two components.

According to other characteristics of the invention:

- the cylindrical external surface of the skirt of the ring gear is provided with a vibration-isolating peripheral layer which is moulded from the said flexible material and which is interposed between the skirt and the complementary portions of the cavity forming a housing for the skirt of the ring gear;
- the damping pins and the vibration-isolating peripheral layer are produced by overmoulding on the ring gear;
- the ring made of rigid material on the one hand and the damping pins and isolating peripheral layer made of flexible material on the other hand are produced simultaneously according to the technique of moulding two materials, rigid and flexible respectively;
- the damping pins extend axially forwards from the external face of the transverse wall of the ring gear and cooperate through their axially oriented opposite lateral faces with portions of facing surfaces, each pair of which delimits laterally a complementary axial groove formed in the cavity of the casing;
- the ring gear has a series of connecting arms which extend axially, from the external face of its transverse wall, inside the damping pins;
- the transverse wall of the ring gear has a series of emerging axial holes, through each of which there extends a flexible material for moulding a damping pin to constitute a foot for anchoring the corresponding pin on the ring gear;
- the damping pins are distributed angularly in a regular manner around the axis of the ring gear;
- the central hole in the ring gear delimits a bearing for the rotational guidance of the output shaft of the gearbox, and the internal surface of the bearing is provided with a vibration-isolating layer which is moulded from the said flexible material and which is interposed between the internal surface of the bearing and a bearing shell for guiding the output shaft in rotation;
- the peripheral isolating layer has a rib for the angular location of the ring gear in the cavity of the casing.

BRIEF DESCRIPTION OF THE DRAWINGS

Other characteristics and advantages of the invention will emerge from a reading of the following detailed description, for an understanding of which reference will be made to the accompanying drawings, in which.

DETAILED DESCRIPTION OF THE PREFERRED EMBODIMENTS

Figure 1:
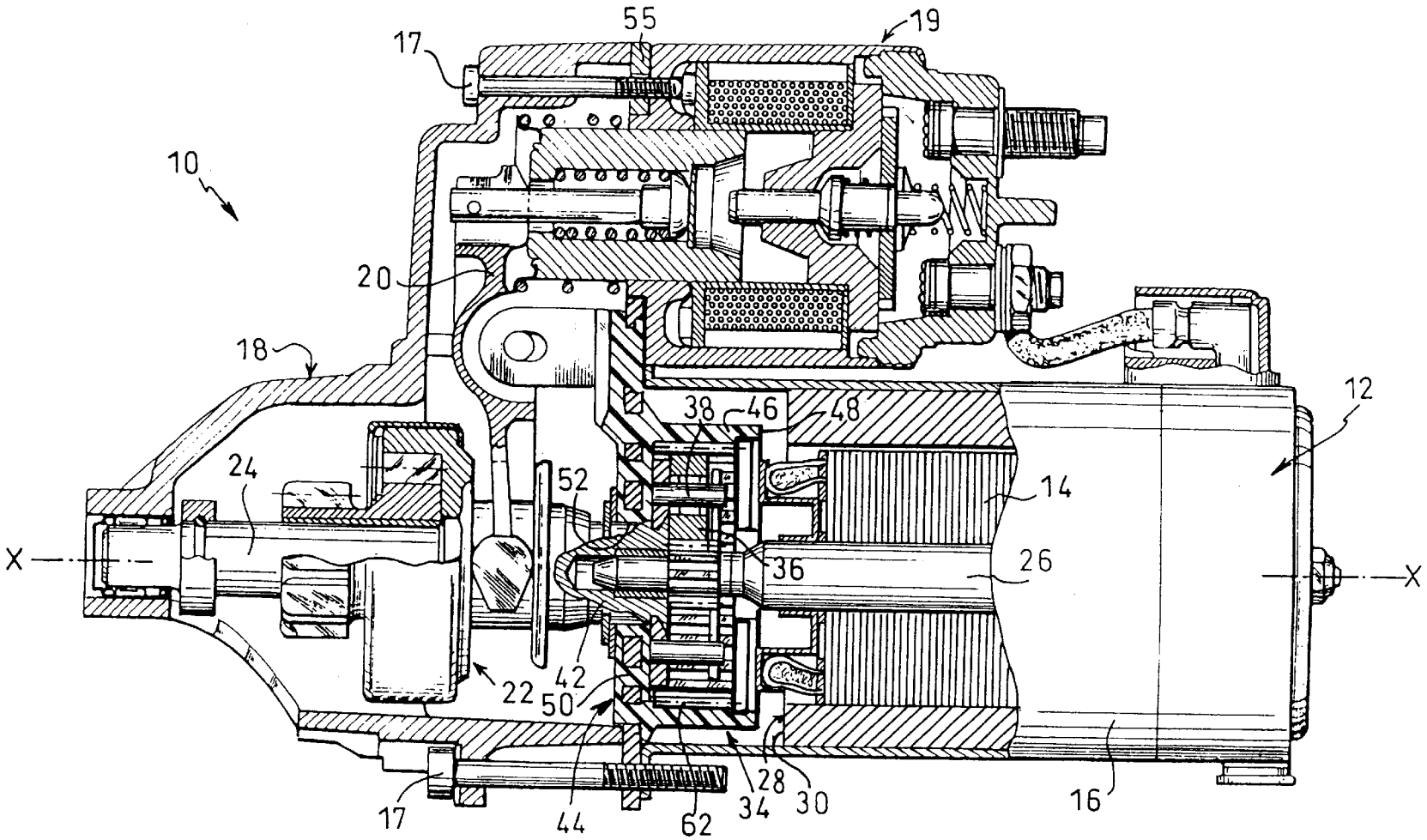
FIG. 1 is a partial axial section view of an example embodiment of a starter of the epicyclic gearbox type according to the state of the art.

FIG. 1 depicts a motor vehicle starter 10 of the type having an electric motor 12 whose rotor 14 is mounted so as to rotate about an axis X—X inside a rear part 16 of the casing of the starter, which is supplemented by a front part 18 in the form of a cover.

The top part of the starter 10 has an electromagnetic contactor 19 which, by means of a lever 20 in the form of a fork, acts in a known manner on a starter head 22 which is mounted so as to slide on a starter shaft 24 coaxial with the output shaft 26 of the electric motor 12.

The output shaft 26 of the electric motor 12, connected with respect to rotation to the rotor 14, projects axially forwards beyond the front face 28 of the stator 30 and rotates a pinion 32 which is the sun gear of an epicyclic gear train 34 which constitutes a gearbox interposed between the output shaft 26 and the starter shaft 24.

The sun gear 32 cooperates with the planetary gears 36 of the epicyclic gear train 34 which are mounted for rotation about shafts 38 carried by a radially oriented transverse planet-carrier plate 40 which is connected rotationally to the output shaft 42 of the gearbox 34, which is connected rotatably to the rear end (not shown) of the starter shaft 24 for rotating the latter by means of the output shaft 42.

The epicyclic gear train 34 also has an internally toothed ring gear 44 inside which the planets 36 mesh and which is immobilised rotationally with respect to the casing of the starter 10.

The internal cylindrical surface of the skirt 46 is toothed and has for this purpose a series of teeth 62 which extend over the entire axial length of the toothed internal surface 61, that is to say in particular substantially as far as the end of the ring gear 44 consisting of the internal transverse face 64 of the wall 50.

The ring gear 44 consists essentially of a cylindrical annular skirt 46 which is open axially at its rear end 48 and whose front end is closed by a radially oriented transverse wall 50 which has a hole 52 at its centre in which, with the interposing of a sleeve 54, the output shaft 42 is mounted for rotation.

In this example embodiment according to the state of the art, the internally toothed ring gear 34 is a part moulded from rigid plastics material which is moulded onto a metallic plate 55 which lies in a transverse plane perpendicular to the axis X—X and which serves as a support for different components of the starter 10 to which they are connected by mounting screws 17 which act notably in order to fix together the rear 16 and front 18 parts of the casing of the starter as well as the contactor 19.

A description will now be given in detail of the embodiment illustrated in FIGS. 2 to 5.

In this example embodiment, there is no transverse intermediate plate for fixing the different components and the two parts of the casing 16 and 18 are clamped axially directly by screws 17.

The peripheral surface 56 of the skirt 46 of the ring gear 44 is a cylindrical surface and the ring gear 44 is received in a complementary hollow cylindrical cavity 58 formed in the cover 18 of the casing of the starter 10 and which is open axially towards the rear to allow the axial insertion, from right to left looking at FIG. 1, of the ring gear 44 in the cavity 58.

More precisely, the ring gear 44 is a part moulded from rigid or semirigid material, for example plastics material or metal, this rigid body of the ring gear 44 constituting a core covered, in different areas, with parts moulded from a flexible material M2 such as for example rubber or an elastomer material.

The rigid material M1 constituting the body of the ring gear 44 of the epicyclic gear train 34 permits the transmission of forces in order to ensure the reduction in movement and the rotation of the shaft of the starter head 24 by the output shaft 26 of the electric motor 12, whilst the parts moulded from the flexible material M2 have essentially functions of damping torsion and vibration between the epicyclic gear train 34 and the components of the casing of the starter 10.

Thus the cylindrical external surface 63 of the skirt 46 made from rigid material is covered with a peripheral layer C of vibration isolation moulded from the flexible material M2 and which is interposed between the skirt 46 and complementary portions of the cavity 58 so that the external peripheral surface 56 of the skirt of the ring gear 44 in contact with the casing element 18 is the external surface of the peripheral layer C made of flexible material M2.

As can be seen in the figures, the peripheral vibration-isolation layer C has an axially oriented rib 66 which is a rib for the angular location of the ring gear 44 in the cavity 58 of the casing in two parts 16, 18.

The ring gear 44 also has pins P produced by moulding from flexible material M2, which fulfil a function of torsion damping between the ring gear 44 and the casing 16, 18 of the starter 10.

In the example illustrated in the figures, the pins P are six in number and are distributed angularly in a regular manner around the axis X—X of the ring gear 44.

Figure 2:
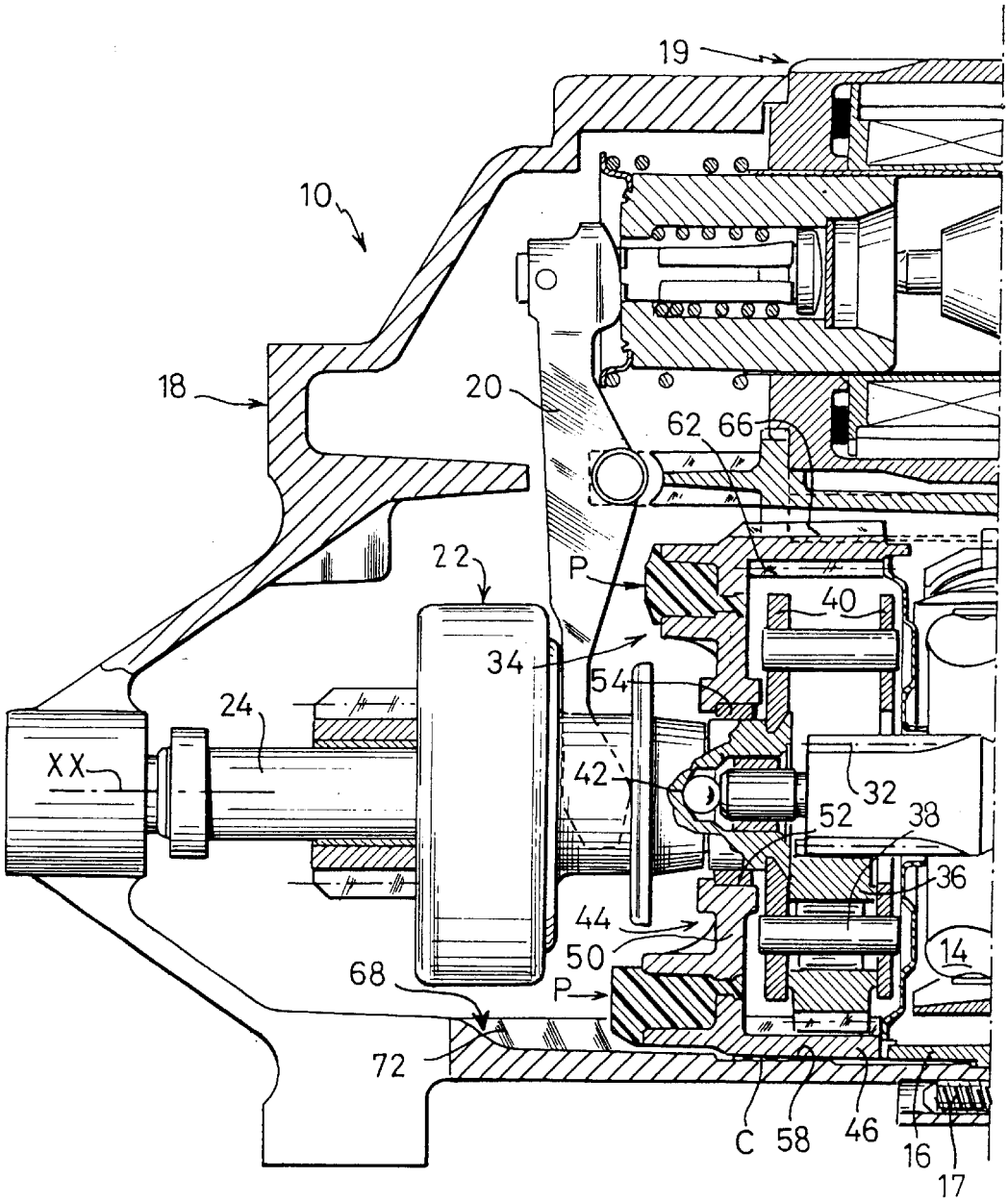
FIG. 2 is a view to a larger scale of part of a starter with an epicyclic gearbox produced in accordance with the teachings of the invention.
Figure 4:
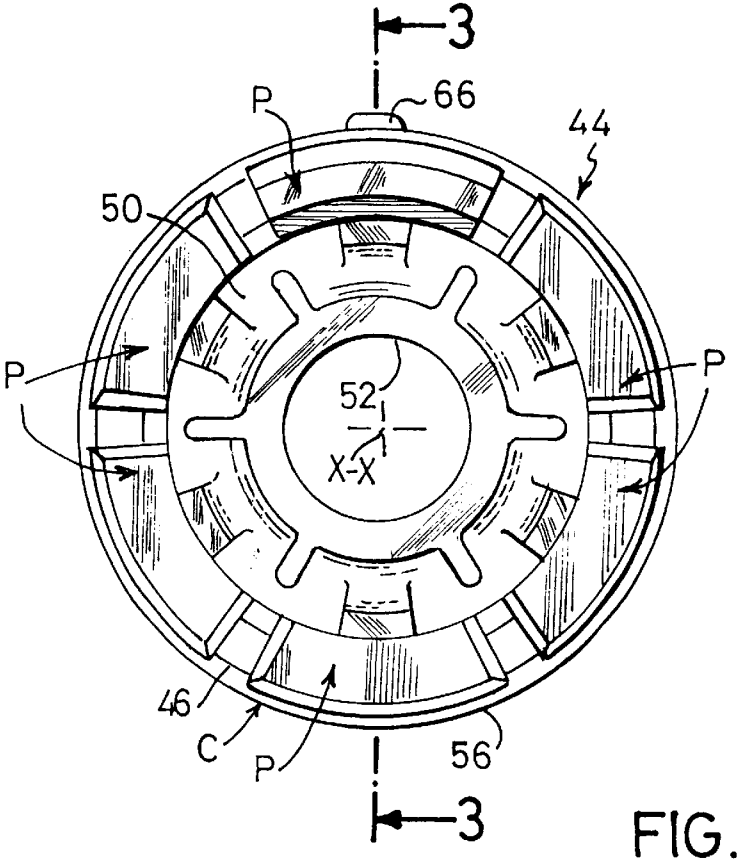
FIG. 4 is an end axial view in the direction of the arrow F4 in FIG. 3.
Figure 3:
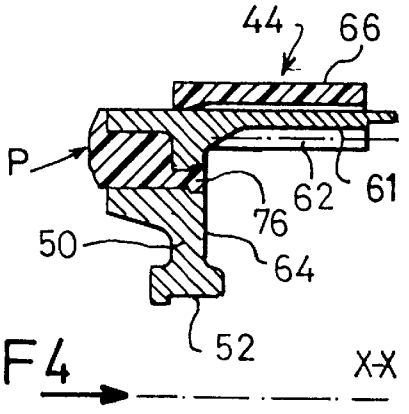
FIG. 3 is a view, in section along the line 3—3 in FIG. 4, which illustrates the internally toothed ring gear of the epicyclic gear train of FIG. 2.
Figure 3:
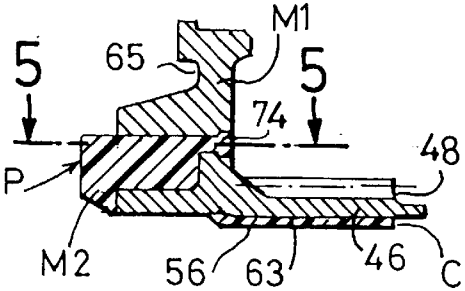

As can be seen in FIGS. 2 to 4, five of the pins P are identical whilst the sixth pin, that is to say the top pin looking at the figures, which is adjacent to the angular location rib 66, has an axial length which is reduced towards the front, notably to facilitate the arrangement of the lever 20.

As can be seen in FIGS. 2 and 3, the pins P extend axially from rear to front, that is to say from right to left looking at these figures, so as to project axially beyond the transverse mid-plane of the transverse wall 50, from the external transverse face 65 thereof, in order each to be received in an axial groove 68 formed in the housing or cavity 58 and which open out axially towards the rear to allow the axial insertion of the pins P in the grooves 68.

More precisely, each pin P is delimited by two opposite lateral faces 70 of roughly axial orientation, each of which cooperates with a facing surface portion 72 delimiting laterally a complementary axial groove 68.

In the example illustrated in the figures, the peripheral layer C and the pins P are produced simultaneously in an operation of moulding on flexible material M2 around the body or core made of rigid material M1 of the ring gear 44.

To obtain good attachment of the moulded-on pins P, the transverse wall 50 has a series of emerging axial holes 74, through each of which there extends flexible moulding material M2 for a damper pin P to constitute a foot 76 for anchoring the corresponding pin P on the ring gear made of rigid material 44.

In the example illustrated in the figures, each pin P has an anchoring foot 76 but the invention is not limited to this arrangement.

Since the pins P provide a function of immobilising the ring gear 44 rotationally with respect to the casing 16, 18 and a function of torsion damping between the ring gear 44 and the casing 18, it is necessary to provide a good tangential rotational connection between the pins P and the rigid body of the ring gear 44.

Figure 5:
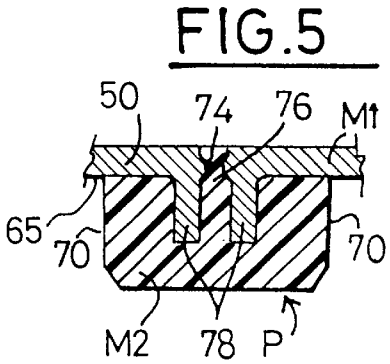
FIG. 5 is a detail view in section along the line 5—5 in FIG. 3.

For this purpose, as can be seen in FIG. 5, the transverse wall 50 has, in line with each pin P, a pair of connecting arms 78, each of which extends axially away from the rear from the external face 65 of the wall 50 (i.e., away from the epicyclic gear train): in order to extend inside the body, made of material M2, of a corresponding pin P.

According to a variant embodiment, not depicted in the figures, and still in order to limit the transmission of harmful noise, it is possible to provide the internal surface of the hole 52 in the body made of rigid material M1 of the ring gear 44 with an internal peripheral layer made of flexible material M2.

The invention is not limited to the case where the components made of flexible material M2 are moulded on around the rigid body made of material M1.

It is also possible to produce the ring gear 44 from rigid material M1 on the one hand and the components moulded from flexible material M2 on the other hand simultaneously according to a bi-material moulding technique.

What is claimed is:

1. Motor vehicle starter (10) having a casing (18) in which there is arranged an electric motor (12) provided with an output shaft (26) which rotates a coaxial starter head (22) with the interposing of an epicyclic gearbox (34) comprising a ring gear (44) made of rigid material (M1), with internal teeth (62), which is housed at least partially in a cavity (58) in the casing and which has an internally toothed cylindrical annular skirt (46) closed at its front axial end by a radially oriented transverse wall (50), having an external face (65), with a hole at its centre (52) for an output shaft (42) of the gearbox to pass, wherein the ring gear (44) has pins (P) moulded from a flexible material (M2), which are interposed between the ring gear (44) and complementary portions (68) of the cavity (58) of the casing (16, 18) in order to immobilise the ring gear (44) rotation-wise with respect to the casing (18) and provide a torsion damping function between the ring gear (44) and the casing (18), and wherein each pin is delimited by two opposite lateral faces, each of which cooperates with a facing portion delimiting laterally a complementary axial groove.

2. Starter according to claim 1, wherein the cylindrical external surface (63) of the skirt (46) of the ring gear (44) is provided with a vibration-isolating peripheral layer (C) which is moulded from the said flexible material (M2) and which is interposed between the skirt (46) and the complementary portions of the cavity forming a housing (58) for the skirt of the ring gear.

3. Starter according to claim 2, wherein the damping pins (P) and the vibration-isolating peripheral layer (C) are produced by overmoulding on the ring gear (44).

4. Starter according to claim 2, wherein the ring made of rigid material (M1) on the one hand and the damping pins (P) and isolating peripheral layer (C) made of flexible material on the other hand are produced simultaneously according to the technique of moulding two materials, rigid (M1) and flexible (M2) respectively.

5. Starter according to claim 4, wherein the damping pins (P) extend axially forward from the external face (65) of the transverse wall (50) of the ring gear (44) and cooperate through their axially oriented opposite lateral faces (70) with portions of facing surfaces (72), each pair of which delimits laterally a complementary axial groove (68) formed in the cavity (58) of the casing (18).

6. Starter according to claim 5, wherein the ring gear (44) has a series of connecting arms (78) which extend axially, away from the external face (65) of its transverse wall (50), inside the damping pins (P).

7. Starter according to claim 5, wherein the transverse wall (50) of the ring gear has a series of emerging axial holes (74), through each of which there extends a flexible material (M2) for moulding a damping pin (P) to constitute a foot (76) for anchoring the corresponding pin (P) on the ring gear (44).

8. Starter according to claim 7, wherein the damping pins (P) are distributed angularly in a regular manner around the axis (X-X) of the ring gear (44).

9. Starter according to claim 8, wherein the central hole (52) in the ring gear delimits a bearing for the rotational guidance of the output shaft (42) of the gearbox (34).

10. Starter according to claim 2, wherein the peripheral isolating layer (C) has a rib (66) for the angular location of the ring gear (44) in the cavity (58) of the casing (16, 18).

11. Starter according to claim 1, wherein the flexible material (M2) of pins (P) consists of elastomer.

* * * * *